United States Patent [19]

Larsson

[11] 4,296,825

[45] Oct. 27, 1981

[54] ROCK DRILL

[75] Inventor: Lars E. Larsson, Sandviken, Sweden

[73] Assignee: Sandvik Aktiebolag, Sandviken, Sweden

[21] Appl. No.: 81,785

[22] Filed: Oct. 4, 1979

Related U.S. Application Data

[63] Continuation-in-part of Ser. No. 854,752, Nov. 25, 1977, abandoned.

[51] Int. Cl.[3] ..... E21C 13/01

[52] U.S. Cl. ..... 175/410; 175/417

[58] Field of Search ..... 175/389, 390, 400, 403, 175/414, 415, 410, 417, 418

[56] References Cited

U.S. PATENT DOCUMENTS

| | | | |
|---|---|---|---|
| 2,464,781 | 3/1949 | Baker | 175/415 |
| 2,579,268 | 12/1951 | Malherbe | 175/400 X |
| 2,725,216 | 11/1955 | Brown | 175/417 |
| 2,749,705 | 8/1956 | Bjorkman | 175/389 |
| 3,004,767 | 10/1961 | Greene et al. | 279/103 |
| 3,100,545 | 8/1963 | Zimmerman | 175/410 X |
| 3,185,228 | 5/1965 | Kelly, Jr. | 175/418 X |
| 3,258,077 | 6/1966 | Phipps | 175/389 |
| 3,357,507 | 12/1967 | Stewart | 175/418 X |
| 3,519,092 | 7/1970 | Miller | 175/410 |
| 3,800,892 | 4/1974 | Fischer | 175/418 X |
| 3,885,638 | 5/1975 | Skidmore | 175/390 |
| 3,997,011 | 12/1976 | Staroba | 175/400 |
| 4,005,906 | 2/1977 | McKenry et al. | 175/410 X |
| 4,151,889 | 5/1979 | Lister | 175/410 |

FOREIGN PATENT DOCUMENTS

| | | | |
|---|---|---|---|
| 560370 | 3/1944 | United Kingdom | 279/103 |

*Primary Examiner*—James A. Leppink

*Attorney, Agent, or Firm*—Burns, Doane, Swecker & Mathis

[57] ABSTRACT

A rock drill for percussion drilling comprising a central button insert and a row of outer button inserts. The central button insert extends beyond the outer inserts. For purposes of increasing the drilling rate and the life of the rock drill the ratios of respectively this extent (X) to the diameter (D) of the hole; X:D, and the transverse distance (Y) between the central insert and one of the outer inserts and the diameter (D); Y:D, shall be within predetermined limits.

11 Claims, 5 Drawing Figures

ROCK DRILL

RELATED APPLICATION

This is a Continuation-In-Part of U.S. application Ser. No. 854,752 filed Nov. 25, 1977 by the present inventor now abandoned.

The present invention relates to a rock drill for percussion drilling comprising a bit body which includes a generally transverse front face. A button insert of hard material is mounted in the centre of the front face so that it extends longitudinally outwardly thereof substantially in alignment with the longitudinal axis of the bit body. Circumferentially spaced outer button inserts of hard material are mounted in the front face around the central button insert and extending outwardly of the front face.

In our co-pending U.S. Application Ser. No. 854,752, now abandoned, a rock drill of the above type is disclosed. This disclosure also suggests that the central button insert should extend beyond the outer ends of the outer button inserts which has been found to improve the straightness of the hole.

The present invention seeks to improve the basic design shown in U.S. Appln. Ser. No. 854,752. More particularly, the invention seeks to provide a rock drill of the above type which has a drilling rate as high as possible without causing premature failure of the button inserts.

It is believed that the accuracy of the straightness of the hole is increased if the extent of the central button insert beyond the outer inserts in increased. However, it has been found that the central insert is subject to premature failure in case of too far such an extent. On the other hand, a too short extent causes a decreased drilling rate.

It has also been found that the distance between opposed surfaces on the central button insert and the outer button inserts is a very important parameter with regard to drilling rate and life of the rock drill. It has been found that if this distance exceeds a certain value, the inserts are subject to premature failure.

It is believed that such failure is caused due to the ridge of the rock which is created between the central insert and the outer inserts during drilling. It is also believed, however, that such a ridge, if not too high, favourably affects the drilling rate, since it has a self-sharpening effect on both the central insert as well as on the outer peripheral inserts. Surprisingly it has been found that the extent of the central insert beyond the outer inserts and the transverse distance between said inserts are two parameters, which depend on each other. In other words, a change of the firstmentioned parameter involves a change of the second parameter if the drilling rate and life of the rock drill shall remain as high as possible.

The invention is particularly intended to be used in connection with drilling of holes having a diameter not exceeding 45 mm. In these cases the outer inserts are arranged in an annular row and inclined at an angle relative to the longitudinal axis of the drill body, thereby defining the outer diameter of the hole. It is believed, however, that the dimension requirements which must be met between the central insert and the outer inserts could be applied in drilling of larger holes. In this case the above-mentioned outer inserts refer to the inserts in a row adjacent to the central insert. Thus, there are further inserts radially outwardly of the outer inserts.

The above and other objects of the invention are attained by giving the invention the characterizing features stated in the appending claims.

The invention is described in detail in the following with reference to the accompanying drawing in which one embodiment is shown by way of example. It is to be understood that this embodiment is only illustrative of the invention and that various modifications may be made within the scope of the claims.

In the drawings, FIG. 1 shows a side view of a rock drill according to the invention.

Figure 1:
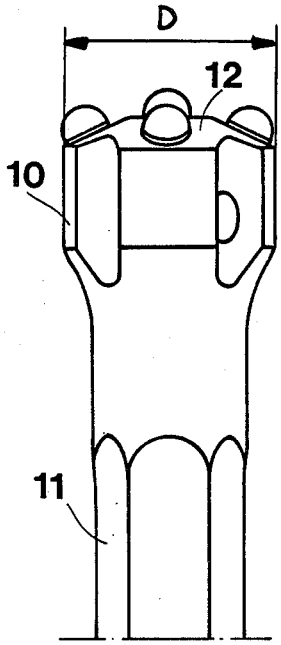

The rock drill comprises a bit body 10, which forms part of an integral drill steel 11. The bit body 10 includes a front face 12 which extends generally transversely relative to the longitudinal axis 13 of the bit body. A button insert 14 of cemented carbide is mounted in the centre of the front face 12. Four button inserts 15 of cemented carbide are mounted in a row around the insert 14. All inserts 14, 15 extend longitudinally outwardly of the front face 12; the central insert 14 extending in alignment with the longitudinal axis 13 and the outer inserts 15 being inclined at an angle relative to the longitudinal axis 13 to define the outer diameter D of the hole. All inserts 14, 15 are secured to the bit body in conventional manner.

According to the invention it has been found that the ratio of the distance Y to the diameter D should be in the range of 8% to 22%, where Y is defined as the distance between opposed side faces on the central insert 14 and one of the outer inserts 15. The distance Y shall be measured at the front face 12. As may be seen in FIG. 3, the contour-line of the front face 12 is broken. The distance Y, however, is measured between the positions where the inserts 14, 15 intersect the front face 12.

Preferably, the ratio of the distance Y to the diameter D should be in the range of 10% to 17%.

Tests, which have been carried out indicate that optimum drilling rate and rock drill life are obtained if the ratio is in the range of 10% to 13% for diameters up to about 30 mm and 12% to 17% for diameters above about 30 mm.

According to the invention it has also been found that the ratio of the distance X to the diameter D should range up to 20%, where X is defined as the outward extent of the outer end of the central insert 14 beyond a transverse plane P through the outer ends of the outer inserts 14. Preferably, the ratio of the distance X to the diameter D should range up to 12%. Tests which have been carried out indicate that optimum drilling rate and rock drill life are obtained if the ratio is in the range of 5% to 10%.

The illustrated embodiment is intended for drilling of small holes, which means that there is only one row of outer inserts 15. The distance Y between the central insert 14 and each of the outer inserts 15 is the same. However, if the invention is applied in rock drills for drilling of larger holes, i.e. drills having inserts radially outwardly of the inserts 15, then the distance Y may vary. The distance Y, however, must be within the above-defined limits for all outer inserts 15.

When applied in drilling of holes having a diameter of 43 mm, it has been found that the distance X should range up to 8.0 mm and that the distance Y should be in the range of 5.0 mm to 10.0 mm. Preferably, the distance X should range up to 4.0 mm. Tests which have been carried out indicate that optimum drilling rate and rock drill life are obtained if the distances X and Y, relatively, are in the range of respectively 2.4 mm to 3.0 mm and 5.5 mm to 7.5 mm. In these tests the diameter d of the central insert 14 has been 7 mm or 8 mm. The outer inserts have had either the same diameter or a diameter 1 mm larger. It is believed that the diameter of the insert 14 in a small hole drill can range up to 10 mm.

Typically, in a successful test an integral drill steel for 43 mm hole diameter had the following data: d = 10 mm, Y = 7.5 mm, and X = 2.8 mm. Thus, the ratios of Y to D and X to D are respectively 17% and 6%. In a test resulting in a premature failure of the inserts an integral drill steel for 43 mm hole diameter had the following data: d = 9 mm, Y = 11 mm, and X = 9.0 mm, Thus, the ratios of Y to D and X to D are respectively 25% and 21%.

Figure 3:
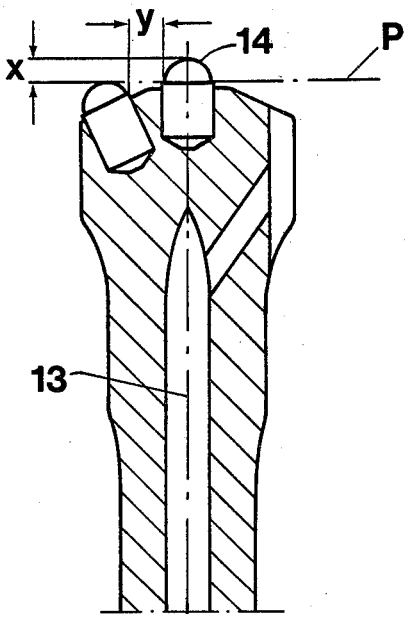
FIG. 3 shows a longitudindal section taken on line III—III in FIG. 2.
Figure 2:
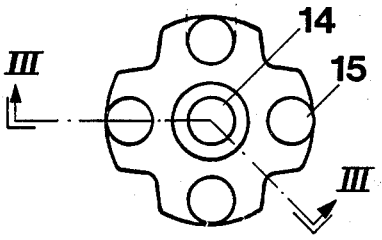
FIG. 2 shows a front view of the rock drill in FIG. 1.
Figure 4:
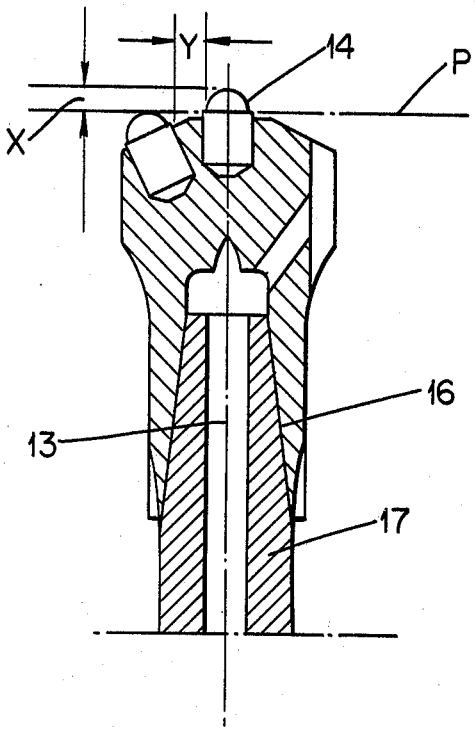
FIG. 4 shows a longitudinal section of a rock drill having a conical mount.

The illustrated embodiment of FIGS. 1 to 3 shows the invention applied in an integral drill steel. The invention, however, may be applied also in conbits as depicted in FIG. 4, where the bit body has a rearwardly extending portion with a conical surface 16 adapted for connection to a drill rod 17 of corresponding conical shape. For that purpose, the previously mentioned U.S. Appln. Ser. No. 854,752 is incorporated herein by way of reference.

Figure 5:
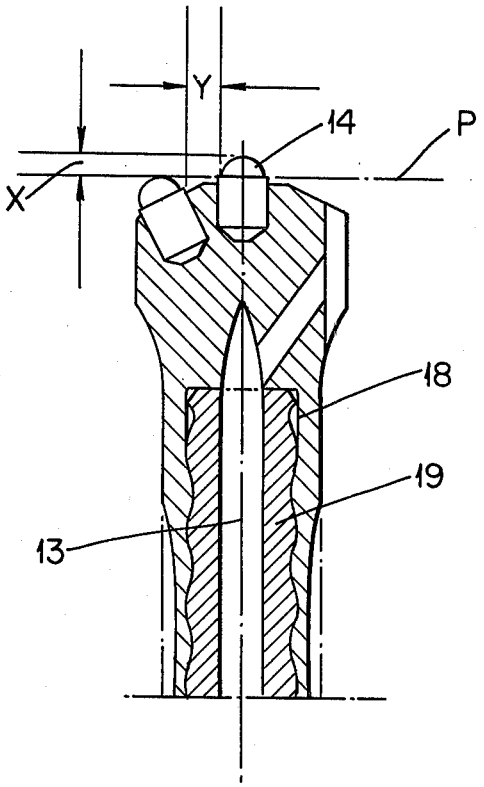
FIG. 5 shows a longitudinal section of a rock drill having a threaded mount.

Further, the drill bit can alternatively be threadedly attached to the drill rod as depicted in FIG. 5. In this case, the bit body has a rear threaded portion 18 of the type shown in U.S. Pat. No. 2,727,216 adapted for connection to a drill rod 19 having corresponding threads.

What I claim is:

1. A rock drill for percussion drilling comprising a bit body, said bit body including a front face extending generally transversely relative to the longitudinal axis of said bit body, a substantially central button insert of hard material, said central button insert extending longitudinally outwardly of said front face substantially in alignment with said longitudinal axis, and at least a first row of circumferentially spaced outer button inserts of hard material, there being more than two outer inserts disposed on more than two different radii from said axis, said outer button inserts extending outwardly of said front face and being inclined at an angle relative to said longitudinal axis and being arranged to define an outer diameter (D) of the hole drilled by the rock drill, said central and outer inserts each including a working surface disposed on the front of a mounting portion of the insert, said mounting portion being embedded along substantially all of its length within said bit body, said working surface being characterized by an absence of an edge extending radially of said longitudinal axis when viewed along said axis, the improvement wherein the ratio of Y to D is in the range of 8% to 22%, where Y is the distance between opposed side faces on said central button insert and at least one of said outer button inserts when measured at said front face, and the ratio of X to D is no greater than 20%, where X is the outward extent of the outer end of said central button insert beyond a transverse plane through the outer end of at least one of said outer button inserts.

2. A rock drill according to claim 1, wherein the ratio of Y to D is in the range of 10% to 17%.

3. A rock drill according to claim 2, wherein the ratio of Y to D is in the range of 10% to 13% for D up to about 30 mm and 12% to 17% for D above about 30 mm.

4. A rock drill according to claim 1, wherein the ratio of X to D is no greater than 12%.

5. A rock drill according to claim 4, wherein the ratio of X to D is in the range of 5% to 10%.

6. A rock drill according to claim 1, wherein the ratio of X to D is no less than 5%.

7. A rock drill for percussion drilling comprising a bit body, said bit body including a front face extending generally transversely relative to the longitudinal axis of said bit body, a substantially central button insert of hard material, there being more than two outer inserts disposed on more than two different radii from said axis, said central button insert extending longitudinally outwardly of said front face substantially in alignment with said longitudinal axis, and a row of circumferentially spaced outer button inserts of hard material, said outer button inserts extending outwardly of said front face and being inclined at an angle relative to said longitudinal axis and being arranged to define an outer diameter (D) of the hole drilled by the rock drill less than 45 mm, said central and outer inserts each including a working surface disposed on the front of a mounting portion of the insert, said mounting portion being embedded along substantially all of its length within said bit body, said working surface being characterized by an absence of an edge extending radially of said longitudinal axis when viewed along said axis, the improvement wherein the outer end of said central button insert extends beyond a transverse plane through the outer ends of said outer button inserts a distance X ranging up to 8.0 mm and the distance Y between opposed side faces on said central button insert and each of said outer button inserts is in the range of 3.0 mm to 10.0 mm.

8. A rock drill according to claim 7, wherein the distance X is no greater than 4.0 mm and the distance Y is in the range of 3.5 mm to 7.0 mm.

9. A rock drill according to claim 8, wherein the ranges of the distances X and Y are respectively 2.4 mm to 3.0 mm and 4.5 mm to 5.5 mm.

10. A rock drill for precussion drilling comprising a bit body, said bit body including a front face extending generally transversely relative to the longitudinal axis of said bit body, a substantially central button insert of hard material, said central button insert extending longitudinally outwardly of said front face substantially in alignment with said longitudinal axis, and at least a first row of circumferentially spaced outer button inserts of hard material, said outer button inserts extending outwardly of said front face and being inclined at an angle relative to said longitudinal axis and being arranged to define on outer diameter (D) of the hole drilled by the rock drill, the improvement wherein the ratio of Y to D is in the range of 10% to 17%, where Y is the distance between opposed side faces on said central button insert and at least one of said outer button inserts when measured at said front face, the ratio of Y to D being in the range of 10% to 13% for D up to about 30 mm and 12% to 17% for D above about 30 mm.

11. A rock drill for precussion drilling comprising a bit body, said bit body including a front face extending generally transversely relative to the longitudinal axis of said bit body, a substantially central button insert of hard material, said central button insert extending longitudinally outwardly of said front face substantially in alignment with said longitudinal axis, and at least a first row of circumferentially spaced outer button inserts of hard material, said outer button inserts extending outwardly of said front face and being inclined at an angle relative to said longitudinal axis and being arranged to define an outer diameter (D) of the hole drilled by the rock drill, the improvement wherein the ratio of X to D is in the range of 5% to 10%, where X is the outward extent of the outer end of said central button insert beyond a transverse plane through the outer end of at least one of said outer button inserts.

* * * * *